United States Patent [19]

Payne

[11] Patent Number: 4,686,613

[45] Date of Patent: Aug. 11, 1987

[54] NON-ROTATABLE TELESCOPING ASSEMBLY

[75] Inventor: William J. Payne, Greensburg, Pa.

[73] Assignee: Crown Creative Industries, Greensburg, Pa.

[21] Appl. No.: 606,356

[22] Filed: May 2, 1984

[51] Int. Cl.[4] ..... F21S 3/12

[52] U.S. Cl. ..... 362/413; 285/178

[58] Field of Search ..... 362/413, 431; 285/178, 285/302, 298; 393/901

[56] References Cited

U.S. PATENT DOCUMENTS

| | | | |
|---|---|---|---|
| 1,309,375 | 7/1919 | Taylor | 362/413 |
| 2,473,218 | 6/1949 | Reichenbach | 362/413 |
| 2,595,597 | 5/1952 | Morseth | 285/302 |
| 2,949,692 | 8/1960 | Kuhn | 285/178 |
| 3,942,826 | 3/1976 | Lester | 285/178 |
| 4,238,818 | 12/1980 | Gindel | 362/413 |

*Primary Examiner*—Ronald B. Cox

*Attorney, Agent, or Firm*—Jon M. Lewis

[57] ABSTRACT

A telescoping support structure is provided having specially shaped inner and outer tubular members which serve to form an essentially non-rotatable elongated structure that can be locked into a desired stable position.

6 Claims, 8 Drawing Figures

NON-ROTATABLE TELESCOPING ASSEMBLY

BACKGROUND OF THE INVENTION

The telescoping assembly described in connection with this invention is primarily intended for use as a support structure in combination with electric lighting apparatus. However, other uses will occur to those skilled in the art. The assembly normally is adjusted in length by the telescoping action of at least two longitudinal members so as to result in an adjustment of the height of the electric lighting apparatus which typically is a lamp. Electric wires are necessarily disposed within the telescoping members. This invention provides a convenient and advantageous structure which permits length adjustment without appreciable relative rotation of the telescoping members thereby preventing possible damage to the wires.

Others have addressed the problem discussed above and solved by this invention. For example, U.S. Pat. Nos. 2,409,075; 2,553,094; 2,624,537; 2,748,261; 2,902,592; 3,012,801; and 4,238,818 are concerned with extensible lamp support structures. However, it is not believed that such structures exhibit this combination of advantages and/or simplicity of design contained in this invention. The present invention offers advantages over prior art telescoping structures by providing a unique combination of advantages including a non rotatable telescoping structure, an integral position clutch and a positive stop indication to resist separation of components. In addition, visual appearance of the structure compared with existing adjustable height lamps without these features is nearly identical. When used as a decorative yet functional component of an electric adjustable height lamp, the elements of this invention do not affect the appearance of the lamp. These benefits as well as other benefits and functions will become more apparent to those skilled in the art from the following description.

SUMMARY OF THE INVENTION

This invention in one aspect provides an essentially non-rotatable telescoping support structure adapted to be used in combination with an electric lamp. The structure includes two members. The first member comprises an outer stationary cylindrical tubular member having a constant radial cross sectional area at each of its two ends and an elliptical cross sectional area between the ends. The second member comprises an inner slidable cylindrical tubular member which is contained within this outer member. The inner member has a constant round radial cross sectional area throughout substantially its length except for one end which has an oval shaped cross sectional area. The inner member is freely slidable within the outer member when the elliptical and oval shaped areas are aligned so as to permit relative movement between the members. The members may be placed in a locked relationship by changing the alignment of the elliptical and oval cross sectional areas by a twisting or rotary manner which creates sufficient contact between the members. Thus a given desired stable length may be readily obtained.

DETAILED DESCRIPTION OF THE INVENTION

The following discussion of the Figures will further aid in an understanding of various embodiments of the invention that are considered to be particularly advantageous.

Figure 1:
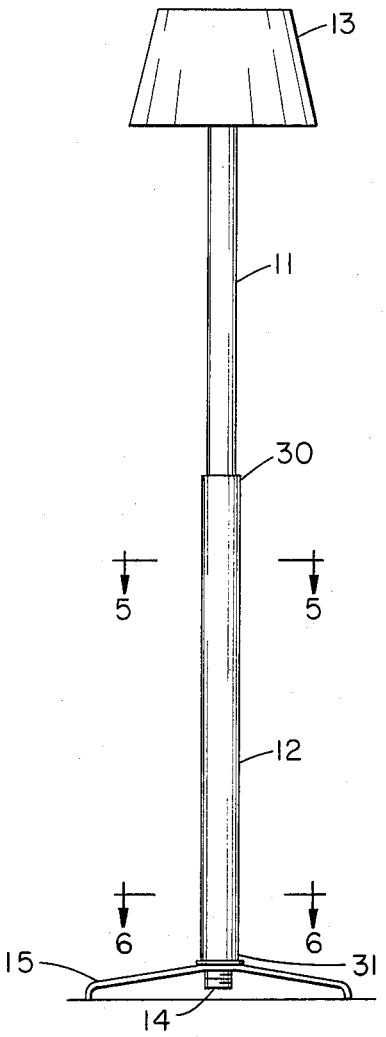
FIG. 1 comprises a side elevational view of a lamp which incorporates the support structure of the invention.

FIG. 1 is a side elevational view of a lamp which incorporates the support structure of the invention. As may be observed, inner tubular member 11 fits within outer tubular member 12. The view shows inner member 11 in an extended position. Outer member 12 contains threaded end 14 which is attached to lamp base 15. The electrical wiring and power source for the lamp is not shown as such components are conventional and consequently are well known. Shade 13 may be attached to inner member 11 in a conventional manner.

Figure 2:
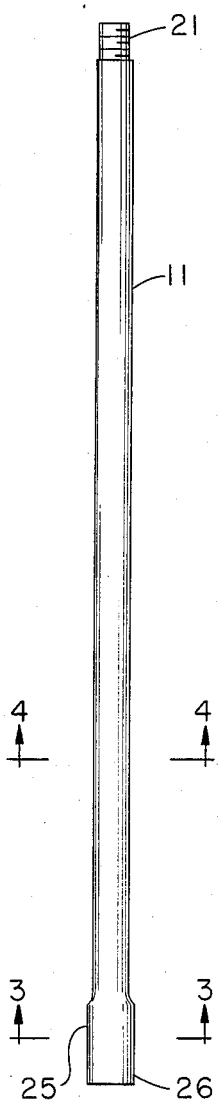
FIG. 2 is a side elevational view of the inner tubular member.

FIG. 2 is a side elevational view of the inner tubular member 11 of the invention. Threaded end 21 is adapted to be connected to a light source portion of the lamp.

Figure 3:
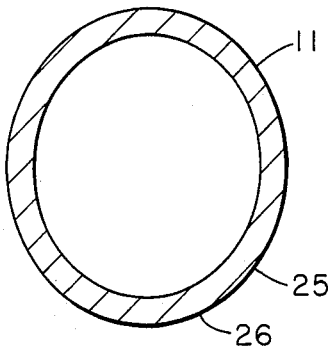
FIG. 3 is a cross sectional view of the inner tubular member taken along section 3—3 of FIG. 2.

Referring to FIG. 3, positive stop indication 26 is provided at one end of inner member 11 to indicate and prevent the inner member 11 from being withdrawn from outer member 12. In the preferred embodiment, positive stop indication 26 is an oval shaped end 25.

FIG. 3 is a cross sectional view taken along line 3—3 of FIG. 2 of the oval shaped end 25 of the inner member 11 at one of its ends. It is very important that the end 25 of inner member 11 is oval as this acts as a positive stop indication 26. In operation, since the ends of outer member 12 are round, 30 and 31, as shown in FIG. 1, there is a definite stopping point. Oval shaped end 25 of inner member 11 thus cannot be withdrawn from outer member 12.

Figure 4:
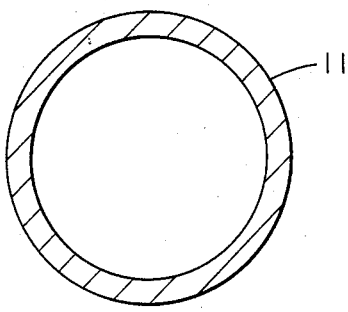
FIG. 4 is a cross sectional view of the inner tubular member taken along section 4—4 of FIG. 2.

FIG. 4 is a cross sectional view taken along line 4—4 of FIG. 4 of the constant radial cross sectional area of the inner member 11 at a mid portion of this member. It is important that a substantial portion of inner member 11 is round so that the structure is easily adjustable in length.

Figure 5:
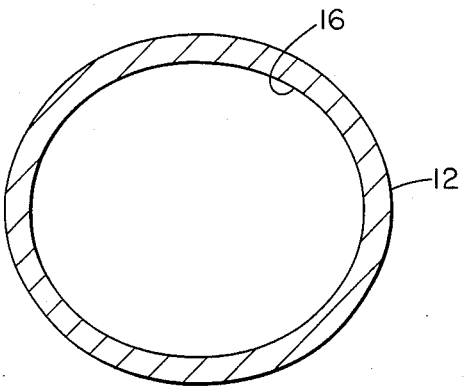
FIG. 5 is a cross sectional view of the outer member taken along section 5—5 of FIG. 1.

FIG. 5 is a cross sectional view of outer member 12 taken along line 5—5 of FIG. 1. This view illustrates a typical elliptical cross section of a mid portion of this member. A substantial portion of outer member 12 is elliptical to allow the structure to telescope, i.e. adjust in length.

Figure 6:
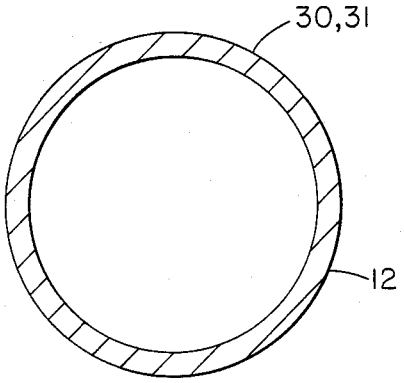
FIG. 6 is a cross sectional view of the outer member taken along section 6—6 of FIG. 1.

FIG. 6 is a cross sectional view of outer member 12 taken along line 6—6 of FIG. 1. This view illustrates a constant radial (round) cross sectional area, 30 and 31, typical of the end two portions of this member. Referring to FIG. 1, 30 refers to the top of outer member 12, and 31 refers to the bottom of outer member 12.

Figure 7:
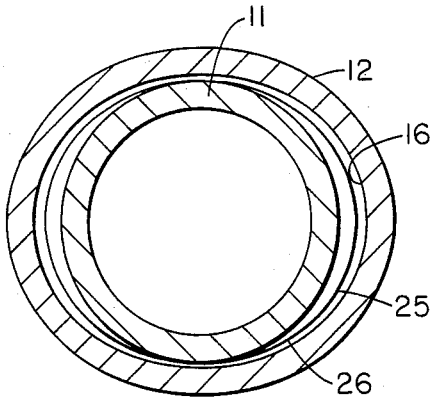
FIG. 7 is a cross sectional view of the inner and outer members in slidable alignment.

FIG. 7 is a cross sectional view of the inner and outer members in slidable alignment.

Figure 8:
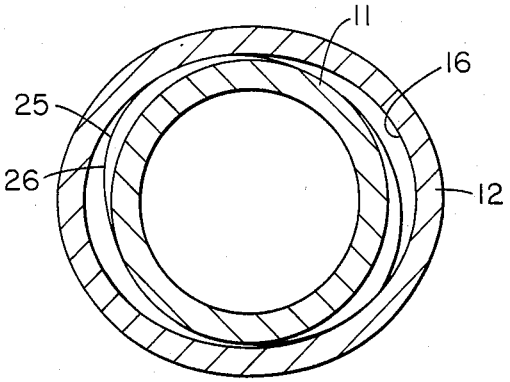
FIG. 8 is a cross sectional view of the inner and outer members in locked alignment.

FIG. 8 is a cross sectional view of the inner and outer members in locked alignment or relationship. Note that a rotation of less than 90 degrees is required to achieve such relationship. In effect, we have an integral position clutch relationship wherein we have a bi-directional action (the oval shaped cross sectional area 25 of inner member 11 touches two sides of inside diameter 16 of elliptical area of outer member 12.) The locked alignment or relationship occurs when oval shaped end 25 of inner member 11 is urged upon the inside diameter 16 of the elliptical portion of outer member 12. Once assembled, the members slide freely, when the clutch is not engaged. A twist in either direction establishes a wedge lock action reversing the direction of twist releases the clutch.

Extending the inner member 11 to full length causes the oval end 25 to contact the round top 30 of outer member 12 providing a positive stop indication 26 to resist separation.

Thus the present invention provides a telescoping supporting means with a dual function capability that will easily lock inner member 11 against both vertical and rotational movement at any point between extremities when the integral position clutch relationship is engaged.

The invention also provides a simple means of providing a positive stop indication 26 to resist separation of components by rounding one end 26 of inner member 11 and the top 30 of outer member 12.

The invention also provides these features from tubular components modified simply in form, inexpensive to assemble and independent of secondary mounts such as plastics that may be affected by conditions of temperature, moisture and humidity.

The invention also eliminates cosmetically objectional grooves, flats, dimples from the structure and to provide instead the appearance of two round tubes sliding one within the other.

We claim:

1. An essentially non-rotatable telescoping support structure adapted to be used in combination with an electric lamp, comprising:

a. an outer stationary cylindrical tubular member having two ends of constant radial cross sectional areas and an elliptical shaped cross sectional area between said ends, said outer member housing a lamp base mounted at one end thereof; and b. an inner slidable cylindrical tubular member contained within said outer member and having two ends with an electric lamp being mounted on one of said ends, said inner member having a constant radial cross sectional area throughout its length except for the other of said ends which has an oval shaped cross sectional area which is smaller than said elliptical area, said inner member being freely slidable within and along said outer member, said elliptical and oval areas are aligned so as to permit relative movement between said members, and said inner member and said outer member being placed in a locked relationship when said elliptical and oval areas are aligned so as to create sufficient contact between said members to prevent movement whereby a desired stable length of said structure may be obtained.

2. The support structure of claim 1, wherein:

said outer member is threaded at one end so as to be adapted to be connected to a lamp base.

3. The support structure of claim 1, wherein:

electric wires are disposed through an interior area formed by said inner and outer members.

4. The support structure of claim 3, wherein:

said outer member is threaded at one end so as to be adapted to be connected to a lamp base.

5. A lamp containing the support structure of claim 4.

6. The support structure of claim 1 wherein:

said oval shaped cross sectional area acts as a positive stop indication when it abuts the radial cross sectional areas of the outer member, so as to prevent the withdrawal of the inner member from the outer member.

* * * * *